US008776735B2

(12) United States Patent
Kosugi et al.

(10) Patent No.: US 8,776,735 B2
(45) Date of Patent: Jul. 15, 2014

(54) COOLING DEVICE OF WATER-COOLED ENGINE AND METHOD OF MANUFACTURING THE SAME

(75) Inventors: Kazuhiro Kosugi, Hiroshima (JP); Yasushi Nakahara, Hiroshima (JP); Daijirou Ishimoto, Hiroshima (JP); Minori Fujino, Hiroshima (JP); Kazuhiro Okino, Hiroshima (JP)

(73) Assignee: Mazda Corporation, Hiroshima (JP)

( * ) Notice: Subject to any disclaimer, the term of this patent is extended or adjusted under 35 U.S.C. 154(b) by 238 days.

(21) Appl. No.: 13/166,658

(22) Filed: Jun. 22, 2011

(65) Prior Publication Data

US 2011/0315098 A1 Dec. 29, 2011

(30) Foreign Application Priority Data

Jun. 29, 2010 (JP) ..... 2010-147070
Apr. 18, 2011 (JP) ..... 2011-092359

(51) Int. Cl.
*F01P 1/02* (2006.01)

(52) U.S. Cl.
USPC ..... 123/41.7; 123/41.43; 123/41.72; 123/41.82 R

(58) Field of Classification Search
CPC ..... F02B 75/20; F02F 1/243; F02F 1/4264; F02F 1/10; F02F 1/40; F01P 2050/12; F01P 2060/04; F01P 2060/16; F01P 2003/021; F01P 2003/024; F01P 2050/04; F01P 3/02; F02M 25/072
USPC ..... 123/41.74, 41.72, 41.81, 41.82 R, 58.1
See application file for complete search history.

(56) References Cited

U.S. PATENT DOCUMENTS

| | | | | |
|---|---|---|---|---|
| 4,579,091 | A * | 4/1986 | Kashiwagi et al. | 123/41.82 R |
| 4,993,227 | A * | 2/1991 | Nagura et al. | 60/605.1 |
| 5,080,049 | A * | 1/1992 | Solomon et al. | 123/41.78 |
| 6,279,516 | B1 * | 8/2001 | Haugen et al. | 123/41.82 R |
| 6,470,867 | B2 * | 10/2002 | Akiwa et al. | 123/672 |
| 6,672,296 | B2 * | 1/2004 | Ito et al. | 123/672 |
| 7,121,248 | B2 * | 10/2006 | Fukuda et al. | 123/196 W |
| 7,798,108 | B2 * | 9/2010 | Konishi et al. | 123/41.79 |
| 8,397,682 | B2 * | 3/2013 | Hamada | 123/41.82 R |
| 2002/0026909 | A1 | 3/2002 | Akiwa et al. | |
| 2005/0145205 | A1 * | 7/2005 | Haubner | 123/41.31 |
| 2006/0196453 | A1 * | 9/2006 | Yamada et al. | 123/41.32 |
| 2009/0165298 | A1 * | 7/2009 | Nagafuchi | 29/888.06 |
| 2010/0089343 | A1 | 4/2010 | Hamada | |
| 2011/0083624 | A1 * | 4/2011 | Megel et al. | 123/41.82 R |

FOREIGN PATENT DOCUMENTS

| | | | |
|---|---|---|---|
| JP | 2000-205043 | A | 7/2000 |
| JP | 2002-070551 | A | 3/2002 |
| JP | 2007-278065 | A | 10/2007 |
| JP | 2008-190497 | A | 8/2008 |

* cited by examiner

*Primary Examiner* — Noah Kamen
*Assistant Examiner* — Long T Tran
(74) *Attorney, Agent, or Firm* — Studebaker & Brackett PC

(57) ABSTRACT

An intake-side space around intake ports and an exhaust-side lower space around exhaust ports are provided in a main cooling jacket portion. These spaces are connected to each other. In a sub cooling jacket portion, an exhaust-side upper space is provided at a level above the exhaust-side lower space. The main cooling jacket portion and the sub cooling jacket portion are connected to each other via a cylindrical-hole connecting passage extending vertically and separate from each other vertically via a wall portion in another area than the connecting passage. Accordingly, a cooling device of an engine which can restrain the exhaust gas from being cooled too much improperly is provided.

2 Claims, 15 Drawing Sheets

COOLING DEVICE OF WATER-COOLED ENGINE AND METHOD OF MANUFACTURING THE SAME

BACKGROUND OF THE INVENTION

The present invention relates to a cooling device of a water-cooled engine and a method of manufacturing the same, and in particular, to a cooling device of a water-cooled engine and a method of manufacturing the same, in which plural cylinders are arranged in line, and a cylinder head with cross-flow type of intake-and-exhaust arrangement includes intake port portions and exhaust port portions which connect to respective combustion chambers and an exhaust collective portion where the exhaust port portions are collected.

In general, an exhaust manifold connects to exhaust ports of a cylinder head outside the cylinder head. Meanwhile, the structure in which inside the cylinder head are formed the exhaust port portions connecting to respective combustion chambers and the exhaust collective portion where the exhaust port portions are collected has been recently proposed aiming at omitting the exhaust manifold, as disclosed in Japanese Patent Laid-Open Publication No. 2000-205043.

In the structure disclosed in the above-described patent document, the exhaust port portions and the exhaust collective portion are formed inside the cylinder head as described above. In this case, the high-temperature exhaust gas may give a large thermal load to the cylinder head. Accordingly, the water jacket may be necessary to cool the cylinder head. Herein, according to the structure disclosed in the above-described patent document, the water jacket is formed to surround the exhaust port portions and the exhaust collective portion. Specifically, the water jackets which are positioned above and below the exhaust port portions and the exhaust collective portion and the water jacket which extends vertically to connect these water jackets are formed inside the cylinder head. The water jacket extending vertically is provided between two exhaust port portions provided at each cylinder and has a shape along these exhaust port portions.

However, since the water jacket surrounds the exhaust port portions and the exhaust collective portion in the above-described structure, there is a problem in that the exhaust gas may be cooled too much improperly.

That is, it is preferable that the exhaust-gas temperature do not increase too high from a perspective of the cylinder head's reliability. From an exhaust-gas treatment standpoint, meanwhile, the high temperature of the exhaust gas is preferable, so it may be needed for the cooling water inside the water jacket not to cool the exhaust port portions and the like excessively.

SUMMARY OF THE INVENTION

The present invention has been devised in view of the above-described matter, and an object of the present invention is to provide a cooling device of a water-cooled engine or a method of manufacturing the same which can restrain the exhaust gas from being cooled too much improperly.

According to the present invention, there is provided a cooling device of a water-cooled engine, in which plural cylinders are arranged in line, and a cylinder head with cross-flow type of intake-and-exhaust arrangement includes intake port portions and exhaust port portions which connect to respective combustion chambers and an exhaust collective portion where the exhaust port portions are collected, the cooling device comprising a main cooling jacket portion of a cooling jacket formed in the cylinder head, the main cooling jacket portion including an intake-side space formed around the intake port portions and an exhaust-side lower space formed around the exhaust port portions, the intake-side space and the exhaust-side lower space being connected to each other, a sub cooling jacket portion of the cooling jacket formed in the cylinder head, the sub cooling jacket portion including an exhaust-side upper space formed at a level above the exhaust-side lower space, and a cylindrical-hole connecting passage extending vertically to connect the main cooling jacket portion and the sub cooling jacket portion, wherein the main cooling jacket portion and the sub cooling jacket portion are separate from each other vertically via a wall portion in another area than the connecting passage.

Accord to the above-described present invention, since the exhaust-side upper space of the main cooling jacket portion and the exhaust-side lower space of the sub cooling jacket portion, which are formed around the exhaust port portions, are vertically connected to each other via the cylindrical connecting passage and also separate from each other via the wall portion, the cooling water can be introduced into the exhaust-side upper space and the exhaust-side upper space can be properly away from the exhaust port portions and the like. Accordingly, the cylinder head can be cooled properly and the exhaust gas inside the exhaust port portions and the like can be restrained from being cooled too much improperly. Further, since the connecting passage connecting the main cooling jacket portion and the sub cooling jacket portion is of the cylindrical shape, casting fins which may form at the connecting passage when these jacket portions are formed by using different cores can be removed easily with a drill or the like.

According to an embodiment of the present invention, the connecting passage connects a portion located between the cylinders of the main cooling jacket portion and a portion located between the cylinders of the sub cooling jacket portion. Thereby, since the vertically-extending connecting passage is further away from the exhaust port portions, compared to a case in which this connecting passage is arranged between the exhaust port portions of each cylinder, for example, the excessive (too-much) cooling of the exhaust gas inside the exhaust port portions by the cooling water flowing through the connecting passage can be restrained properly.

According to another embodiment of the present invention, the main cooling jacket portion comprises a cooling-water introduction portion which is provided at an exhaust-side portion thereof and introduces cooling water from a cylinder block located below the cylinder head into the exhaust-side lower space of the main cooling jacket portion and a main cooling-water discharge portion which is provided at an intake-side portion thereof to connect to the intake-side space and discharges the cooling water flowing inside the main cooling jacket portion to an outside of the cylinder head, the connecting passage and the cooling-water introduction portion are located away from each other in a plan view, and the sub cooling jacket portion comprises a sub cooling-water discharge portion which is provided at an exhaust-side portion thereof to connect to the exhaust-side upper space and discharges the cooling water flowing inside the sub cooling jacket portion to the outside of the cylinder head. According to this structure, the cooling water introduced into the main cooling jacket portion from the cylinder block flows from exhaust-side portion of the main cooling jacket portion toward the main cooling-water discharge portion provided on the intake side. Meanwhile, the cooling water introduced into the sub cooling jacket portion through the connecting passage flows toward the sub cooling-water discharge portion. Herein, since the connecting passage is located at a different position from the cooling-water introduction portion in the plan view, the cooling water which has flowed into the sub cooling jacket portion through the connecting passage is restrained from returning to the main cooing jacket portion. Thereby, the flowing of the cooling water inside the sub cooling jacket portion can be ensured. Also, the cooling water having flowed into the sub cooling jacket portion can be introduced into a heater for vehicle compartment (a heater core for air conditioning) and the like via the sub cooling-water discharge portion, so that the cooling water can be used efficiency.

According to another aspect of the present invention, there is provided a method of manufacturing a cooling device of a water-cooled engine, in which plural cylinders are arranged in line, and a cylinder head with cross-flow type of intake-and-exhaust arrangement includes intake port portions and exhaust port portions which connect to respective combustion chambers and an exhaust collective portion where the exhaust port portions are collected, the method comprising a core setting step of setting a main-cooling-jacket core and a sub-cooling-jacket core, wherein the main-cooling-jacket core comprises an intake-side-space forming portion to form an intake-side space around the intake port portions of the cylinder head and an exhaust-side-lower-space forming portion to form an exhaust-side lower space around the exhaust port portions, the intake-side-space forming portion and the exhaust-side-lower-space forming portion being provided continuously, and the sub-cooling-jacket core comprises an exhaust-side-upper-space forming portion to form an exhaust-side upper space at a level above the exhaust-side lower space of the cylinder head and a connecting-passage forming portion to form a connecting passage connecting the exhaust-side upper space and the exhaust-side lower space, the connecting-passage forming portion extending vertically, and the main-cooling-jacket core is set inside a master mold of the cylinder head, and the sub-cooling-jacket core is set inside the master mold of the cylinder head such that the exhaust-side-upper-space forming portion thereof is upward away from the exhaust-side-lower-space forming portion of the main-cooling-jacket core and a lower face of the connecting-passage forming portion join to an upper face of the exhaust-side-lower-space forming portion of the main-cooling-jacket core, and a casting step of casting the cylinder head through pouring molten metal into a space between the master mold and the main-cooling-jacket and sub-cooling-jacket cores and removing the cores after the molten metal is cooled, whereby a main cooling jacket portion including the intake-side space and the exhaust-side lower space and a sub cooling jacket portion including the exhaust-side upper space and the connecting passage are formed to be connected to each other via the connecting passage inside the cylinder head, and the exhaust-side lower space of the main cooling jacket portion and the exhaust-side upper space of the sub cooling jacket portion are formed to be separate from each other vertically via a wall portion.

According to the above-described method of the present invention, since the core to form the main cooling jacket portion is different from the core to form the sub cooling jacket portion, the respective jacket portions which have complex shapes can be formed easily. Further, since these cores join to each other at the lower face of the connecting-passage forming portion, the main cooling jacket portion and the sub cooling jacket portion are connected to each other and the properly-thick wall portion can be provided between the exhaust-side lower space of the main cooling jacket portion and the exhaust-side upper space of the sub cooling jacket portion. Accordingly, the cooling water is introduced into the exhaust-side upper space, and the cylinder head can be cooled properly and the exhaust gas inside the exhaust port portions and the like can be restrained from being cooled too much improperly. Further, since the jacket portions are formed by using the different cores, the volume of the connecting-passage forming portion, i.e., the volume of the connecting passage, can be more easily adjusted, ensuring the rigidity of the cores, compared to a case in which the jacket portions are formed with a single core.

According to an embodiment of the method of the present invention, in the core setting step, the connecting-passage forming portion of the sub-cooling-jacket core is joined to a portion located between the cylinders of the exhaust-side-lower-space forming portion of the main-cooling-jacket core, and, in the casting step, the connecting passage is formed at a position to connect a portion located between the cylinders of the main cooling jacket portion and a portion located between the cylinders of the sub cooling jacket portion. Thereby, since the vertically-extending connecting passage is formed at a position further away from the exhaust port portions, compared to a case in which the connecting passage is formed between the exhaust port portions of each cylinder, for example, the excessive (too-much) cooling of the exhaust gas inside the exhaust port portions by the cooling water flowing through the connecting passage can be restrained properly.

According to another embodiment of the method of the present invention, the connecting-passage forming portion is of a vertically-extending columnar shape, the connecting passage is formed as a cylindrical hole extending vertically in the casting step, and there is further provided a casting-fin removing step of removing casting fins forming at the connecting passage with a drill inserted into the cylindrical-hole connecting passage. Thereby, the casting fins forming at the lower face of the connecting passage where the main-cooling-jacket core and the sub-cooling-jacket core join to each other can be removed easily, so that the removing of the casting fins can be conducted efficiently and precisely. Accordingly, the work efficiency can be improved and any damage of the cylinder head which may be caused by some remaining casting fins can be restrained.

According to another embodiment of the method of the present invention, the main-cooling-jacket core comprises a cooling-water-introduction-portion forming portion to form a cooling-water introduction portion which introduces cooling water from a cylinder block located below the cylinder head into the exhaust-side lower space of the main cooling jacket portion and a main-cooling-water-discharge-portion forming portion to form a main cooling-water discharge portion which is provided at an intake-side portion of the main cooling jacket portion to connect to the intake-side space of the main cooling jacket portion and discharges the cooling water flowing inside the main cooling jacket portion to an outside of the cylinder head, the sub-cooling-jacket core comprises a sub-cooling-water-discharge-portion forming portion to form a sub cooling-water discharge portion which is provided at an exhaust-side portion of the sub cooling jacket portion to connect to the exhaust-side upper space of the sub cooling jacket portion and discharges the cooling water flowing inside the sub cooling jacket portion to the outside of the cylinder head, the connecting-passage forming portion of the sub-cooling-jacket core is provided at a different position from the cooling-water-introduction-portion forming portion in a plan view in the core setting step, and the cooling-water introduction portion is formed at an exhaust-side portion of the main cooling jacket portion, the main-cooling-water discharge portion is formed at an intake-side portion of the main cooling jacket portion, and the sub cooling-water discharge portion is formed at an exhaust-side portion of the sub cooling jacket portion in the casting step. According to the method of the present embodiment, the cooling-water introduction portion to introduce the cooling water into the main cooling jacket portion from the cylinder block is formed on the exhaust side of the main cooling jacket portion, and the main cooling-water discharge portion to discharge the cooling water inside the main cooling jacket portion to the outside of the cylinder block is formed on the intake side of the main cooling jacket portion. Accordingly, the cooling water introduced into the main cooling jacket portion flows from the exhaust-side portion of the main cooling jacket portion toward the intake side. Meanwhile, the sub cooling-water discharge portion to discharge the cooling water to the outside of the cylinder head is formed at the exhaust-side portion of the sub cooling jacket portion. Accordingly, the cooling water introduced into the sub cooling jacket portion flows toward the sub cooling-water discharge portion. Further, since the connecting passage is formed at the different position from the cooling-water introduction portion in the plan view, the cooling water which has flowed into the sub cooling jacket portion through the connecting passage is restrained from returning to the main cooing jacket portion. Thereby, the flowing of the cooling water inside the sub cooling jacket portion can be ensured. Also, the cooling water having flowed into the sub cooling jacket portion can be introduced into the heater for vehicle compartment (the heater core for air conditioning) and the like via the sub cooling-water discharge portion, so that the cooling water can be used efficiency.

Other features, aspects, and advantages of the present invention will become apparent from the following description which refers to the accompanying drawings.

DETAILED DESCRIPTION OF THE INVENTION

Hereinafter, a preferred embodiment of a cooling device of an engine according to the present invention will be descried referring to the accompanying drawings.

In the figures, an arrow F shows an engine-front side, an arrow R shows an engine-rear side, an arrow IN shows an intake side, and an arrow EX shows an exhaust side.

Figure 1:
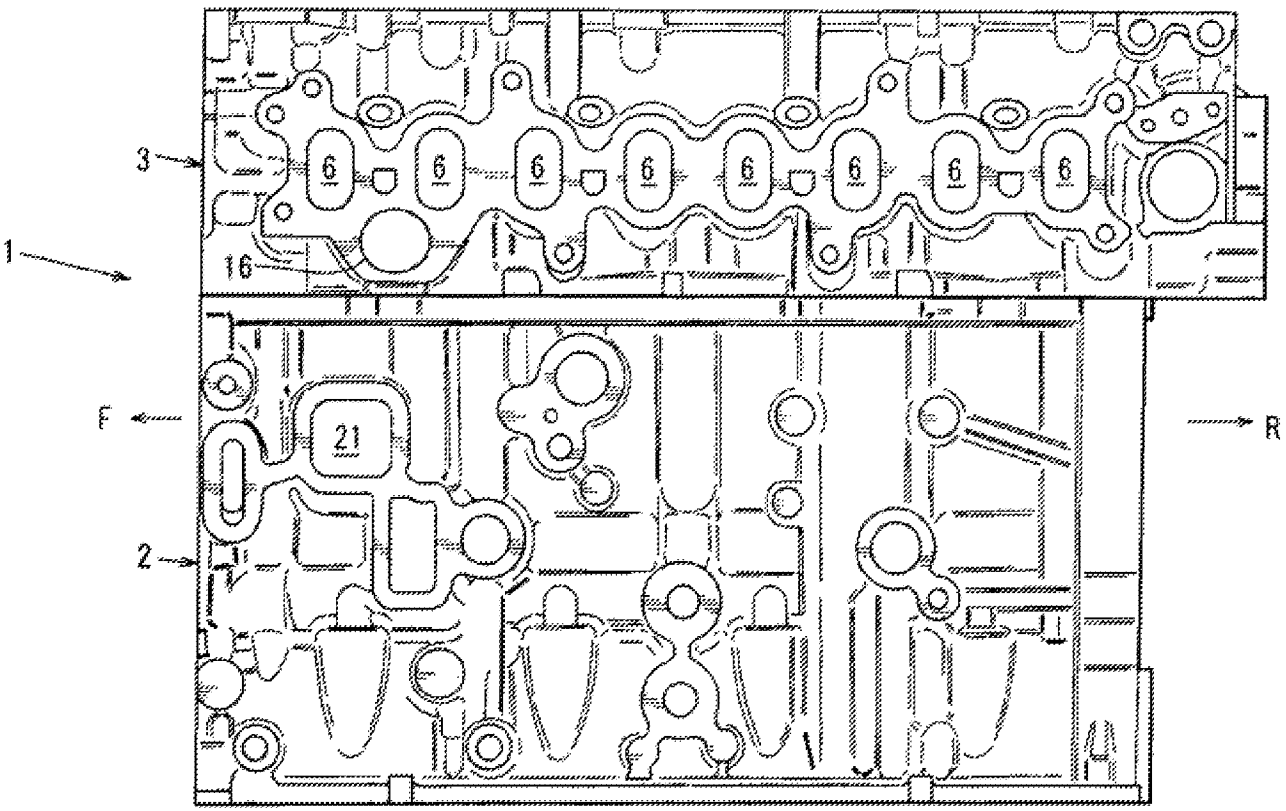
FIG. 1 is a side view of a major part of an engine equipped with a cooling device of a water-cooled engine according to the present invention.

FIG. 1 is a side view of an engine 1. The engine 1 comprises a cylinder block 2, a cylinder head 3 which is fastened to an upper portion of the cylinder block 2, and an oil pan (not illustrated) which is attached to a lower portion of the cylinder block 2, and a cylinder head cover (not illustrated) which is attached to an upper portion of the cylinder head 3.

Figure 2:
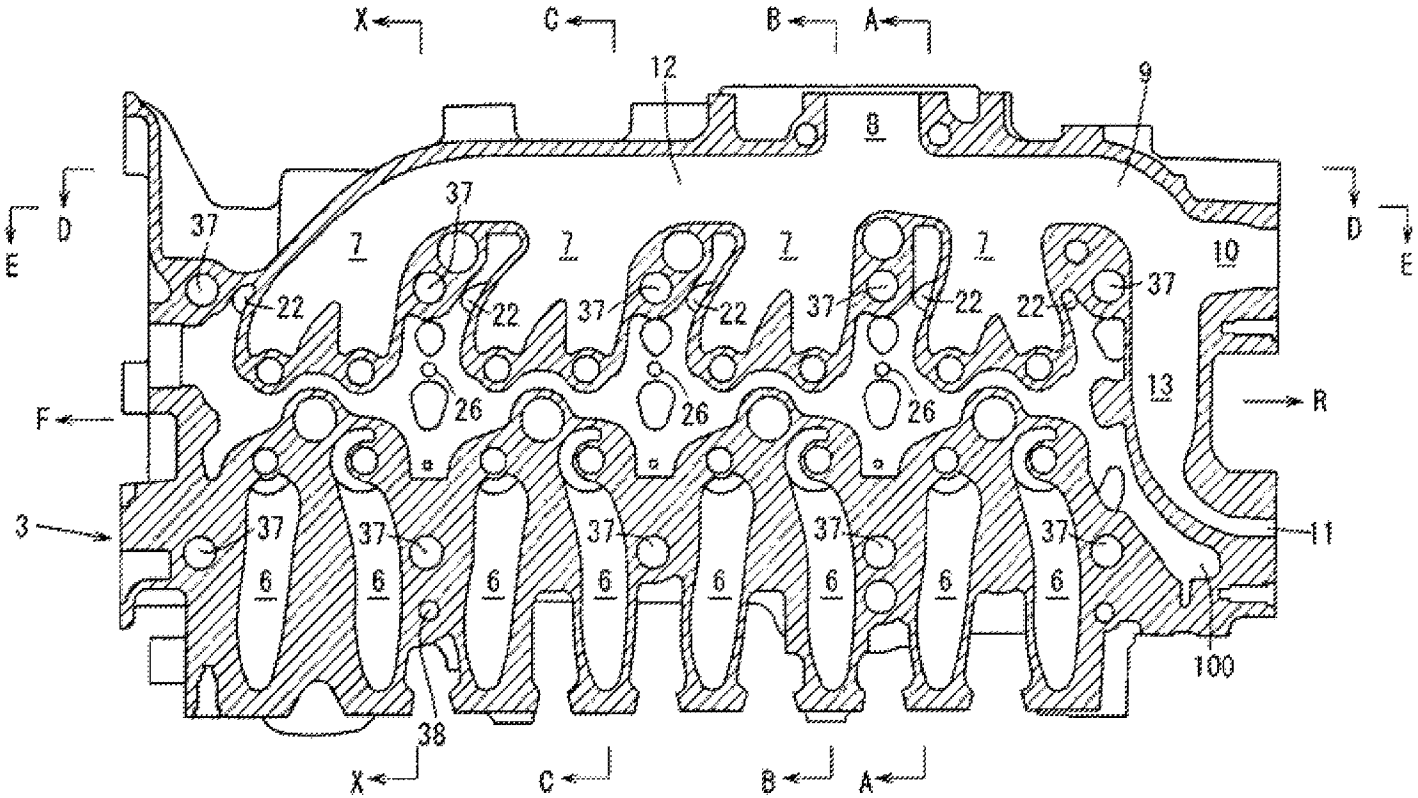
FIG. 2 is a plan view of a cylinder head.
Figure 3:
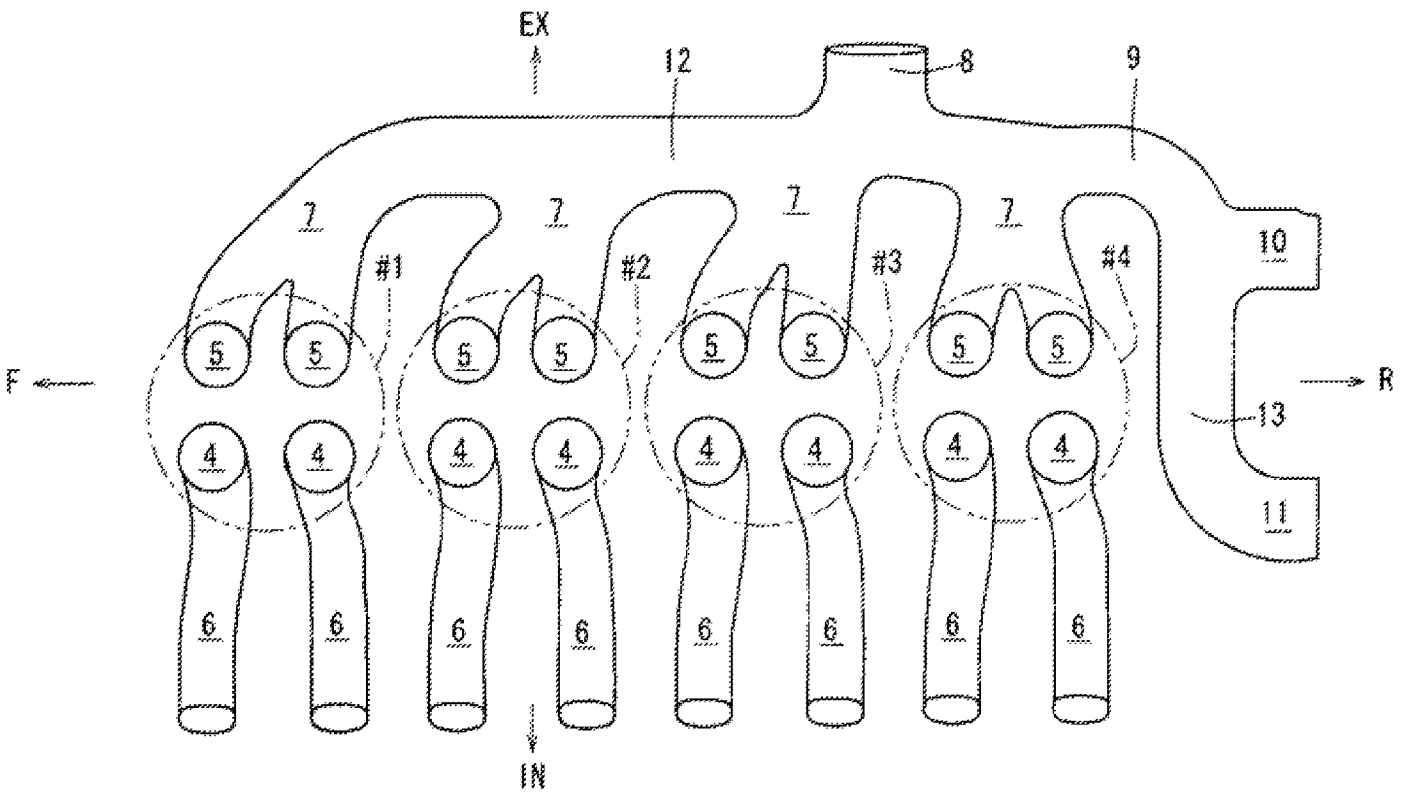
FIG. 3 is a plan view showing a structure of intake and exhaust ports.

FIG. 2 is a plan view of the cylinder head 3. FIG. 3 is a plan view showing a structure of intake and exhaust ports. The engine 1 of the present embodiment is an inline four-cylinder diesel engine. At the engine 1 are formed, as shown in FIG. 3, a first cylinder #1, a second cylinder #2, a third cylinder #3, and a fourth cylinder #4 which are arranged in line from the front to the rear of the engine. The engine 1 of the present embodiment is an engine equipped with two intake valves and two exhaust valves. At the cylinder head 3 are formed two intake-valve openings 4, 4 and two exhaust-valve openings 5, 5 which are arranged for each cylinder. In the present embodiment, the exhaust-valve openings 5, 5 are disposed on one side of the cylinder head 3, the intake-valve openings 4, 4 are arranged at the other side of the cylinder head 3, and the cylinder head 3 is equipped with cross-flow type of intake-and-exhaust arrangement.

Each intake-valve opening 4 connects to each independent intake port 6. The two exhaust-valve openings 5, 5 connect to a common exhaust port 7 which is of a Y shape in a plan view.

An exhaust collective portion 8 is formed at an exhaust-side portion of the cylinder head 3 which corresponds to a portion between the third cylinder #3 and the fourth cylinder #4. The exhaust collective portion 8 connects to each of the Y-shaped exhaust ports 7. Herein, an exhaust pipe (not illustrated) is coupled to a downstream portion of the exhaust collective portion 8 outside the cylinder head 3.

As shown in FIGS. 2 and 3, a connecting passage 12 is formed to connect the exhaust ports 7 and the exhaust collective portion 8, extending in a cylinder-line direction.

A branch passage 9 which branches off the exhaust port 7 of the fourth cylinder #4 is formed at the cylinder head 3. The branch passage 9 extends rearward from the exhaust port 7 and opens at an exhaust-side portion of a rear end face of the cylinder head 3. That is, an opening portion 10 (an opening portion on the exhaust side) is formed at the exhaust-side portion of the rear end face of the cylinder head 3.

An EGR connecting passage 13 which branches off the above-described branch passage 9 is formed at the cylinder head 3. The EGR connecting passage 13 extends in an engine width direction from the vicinity of the opening portion 10 on the exhaust side toward the intake side, and opens an intake-side portion of the rear end face of the cylinder head 3. That is, an opening portion 11 (an opening portion on the intake side) is formed at an intake-side portion of the rear end face of the cylinder head 3.

As described above, the cylinder head 3 has the two opening portions 10, 11 as the opening portions of the connecting passages 9, 13 which are located away from each other in the engine width direction. A water-cooled EGR cooler is connected to the opening portion 10. To the opening portion 11 is connected a bypass pipe which bypasses the EGR cooler.

The exhaust-valve openings 5, the exhaust ports 7, the exhaust collective portion 8, the opening portion 10, the opening portion 11, the connecting passage 12, and the EGR connecting passage 13 constitute an exhaust passage inside the cylinder head 3.

A cooling jacket which comprises a lower jacket 100 (a main cooling jacket portion, see FIG. 9 and others) and an upper jacket 400 (a sub cooling jacket portion, see FIG. 9 and others) is formed at the cylinder head 3. The cooling water to cool the cylinder head 3 flows inside this cooling jacket.

Next, the structure of cores used in forming the lower jacket 100 and the upper jacket 400 at the cylinder head 3 through a casting process will be described referring to FIGS. 4 through 8.

In the present embodiment, a lower core N100 (a main-cooling-jacket core, see FIG. 4), an upper core N400 (a sub-cooling-jacket core, see FIG. 5), a block-jacket core N300 (see FIG. 5), and an exhaust-passage core N200 (see FIG. 4) are used as the cores.

The lower core N100 forms the lower jacket 100. The lower jacket 100 where the cooling water flows expands from the intake side to the exhaust side over an almost entire area along the cylinder-line direction inside the cylinder block 2.

The upper core N400 forms the upper jacket 400 including an upper space on the exhaust side. The upper jacket 400 where the cooling water flows expands over an almost entire area along the cylinder-line direction inside the cylinder block 2 on the upper side of the exhaust-side portion of the lower jacket 100.

Figure 4:
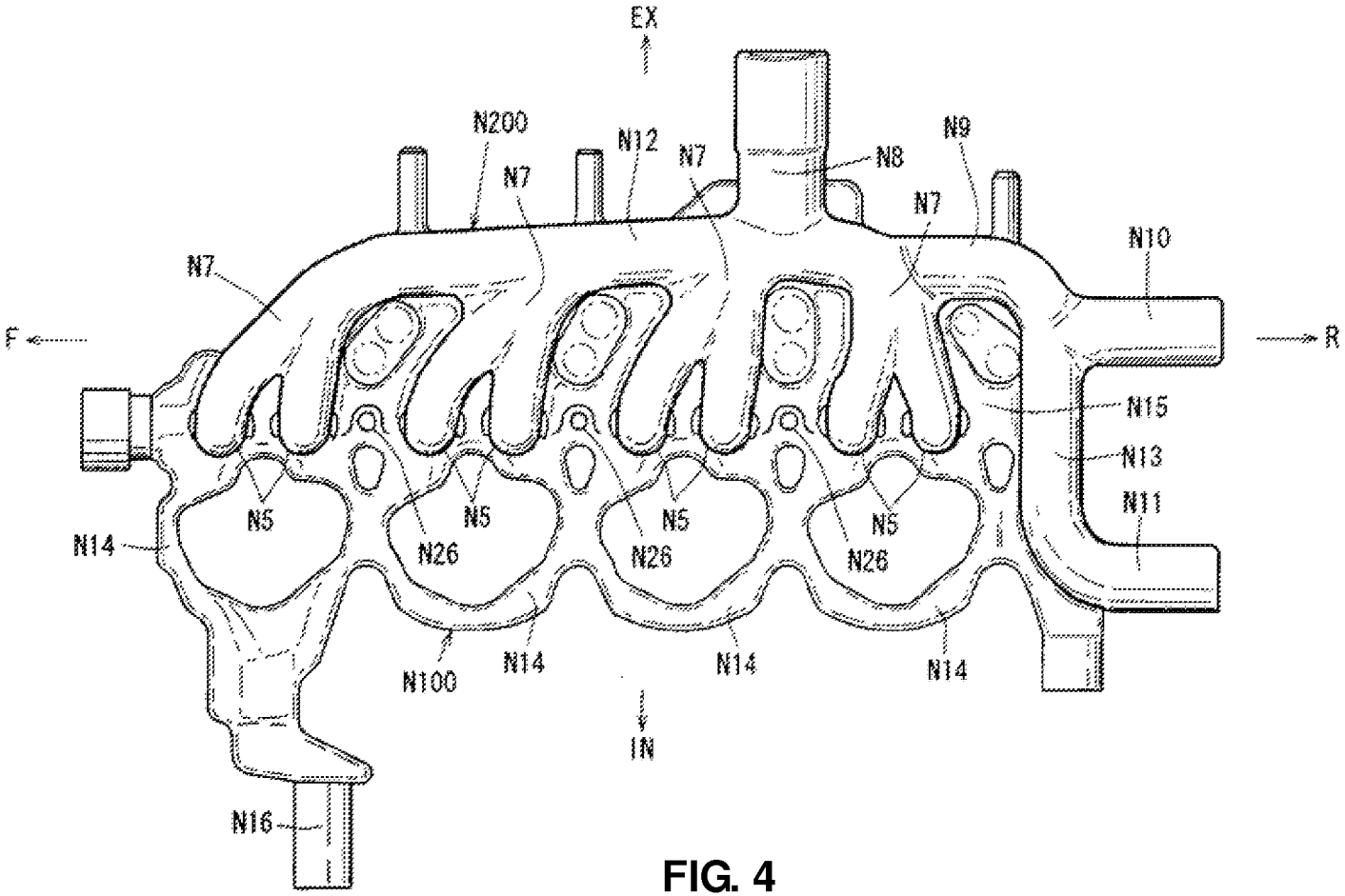
FIG. 4 is a plan view showing a state in which a lower core and an exhaust-passage core are combined together.
Figure 5:
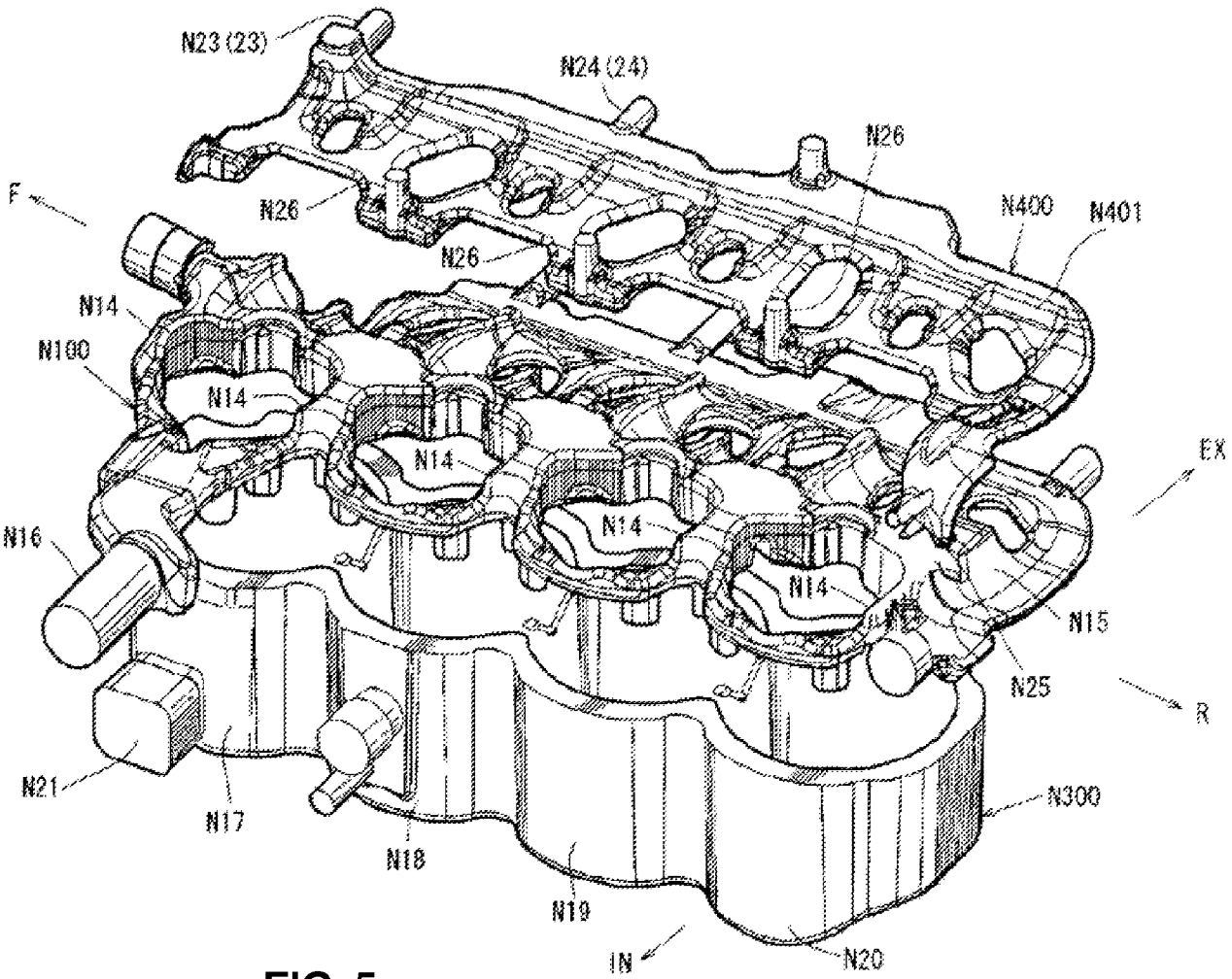
FIG. 5 is an exploded perspective view of a block-jacket core, the lower core, and an upper core.
Figure 6:
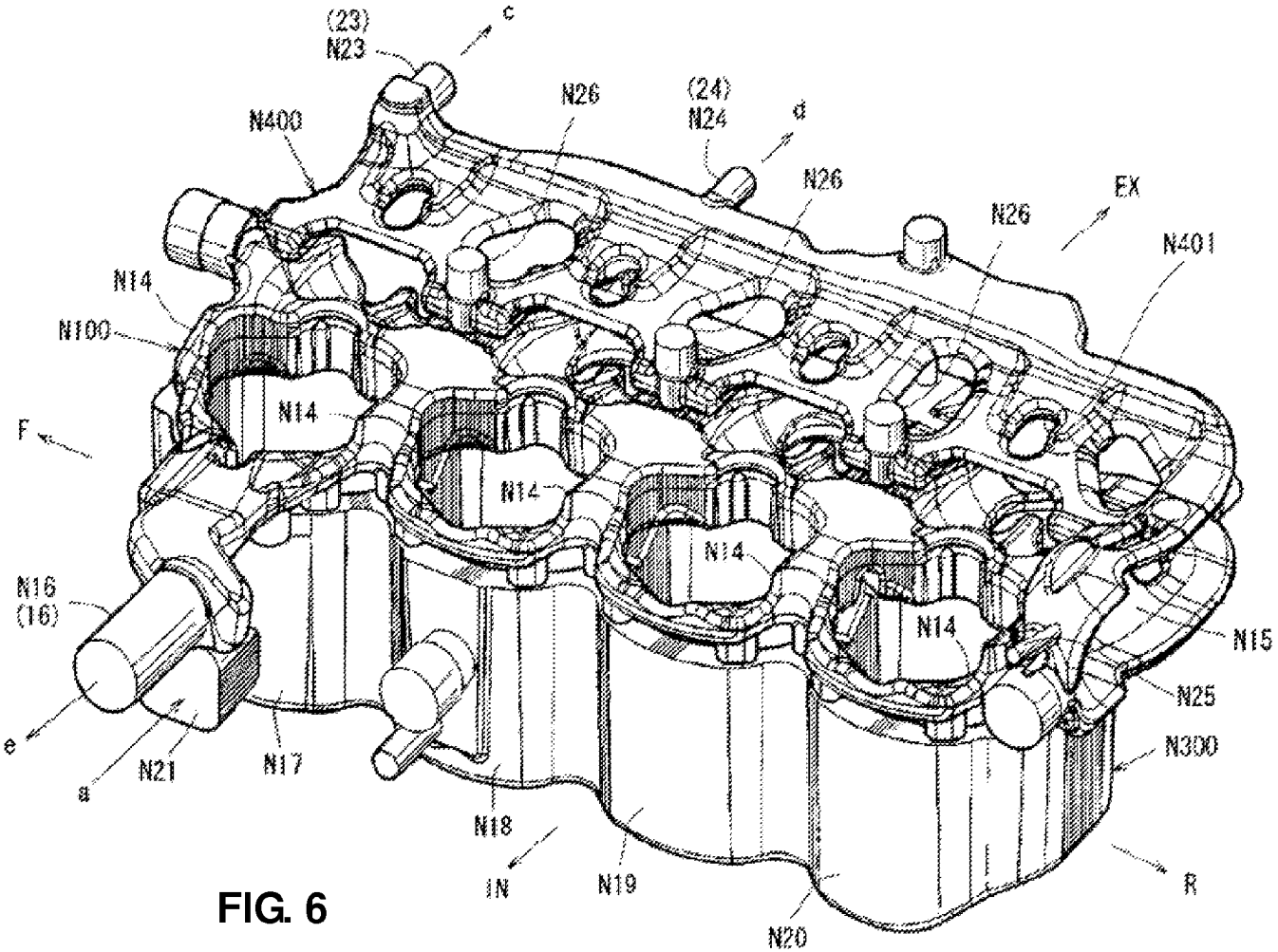
FIG. 6 is a perspective view showing a state in which the block-jacket core, the lower core, and the upper core are combined together.

The block-jacket core N300 forms a water jacket at cylinder-bore peripheral portions of the cylinder block 2. The exhaust-passage core N200 forms the exhaust passage at the cylinder head 3. FIG. 4 is a plan view showing a state in which the lower core N100 and the exhaust-passage core N200 are combined. FIG. 5 is an exploded perspective view of the block-jacket core N300, the lower core N100, and the upper core N400. FIG. 6 is a perspective view showing a state in which the block-jacket core N300, the lower core N100, and the upper core N400 are combined together.

As shown in FIGS. 4, 5 and 6, the lower core N100 to form the lower jacket 100 comprises intake-side-space forming portions N14 and an exhaust-side-lower-space forming portion N15 which respectively correspond to the respective cylinders, a main-cooling-water-discharge-portion forming portion N16, and plural cooling-water-introduction-portion forming portions N22 (not illustrated). These all forming portions are formed integrally. The intake-side-space forming portions N14 form an intake-side space 14 (see FIG. 9 and others) around the intake ports 6 of the respective cylinders inside the cylinder head 2. The exhaust-side-lower-space forming portion N15 form an exhaust-side lower space 15 (see FIG. 9 and others) which expands below the exhaust passage, including a space around the exhaust ports 7 of the respective cylinders. The intake-side-space forming portions N14 and the exhaust-side-lower-space forming portion N15 are formed continuously, and the intake-side space 14 and the exhaust-side lower space 15 which are formed by the forming portions N14, N15 are connected to each other.

The main-cooling-water-discharge-portion forming portion N16 forms inside the cylinder head 3 a main-cooling-water discharge portion 16 (see FIG. 1) which connects to the above-described intake-side space 14 to discharge the cooling water inside the lower jacket 100 from the inside to the outside of the cylinder head 3. The main-cooling-water-discharge-portion forming portion N16 projects toward the intake side from an intake-side end portion of the lower core N100 near the first cylinder #1, and the main-cooling-water discharge portion 16 is formed at an intake-side end portion of the lower jacket 100.

Figure 7:
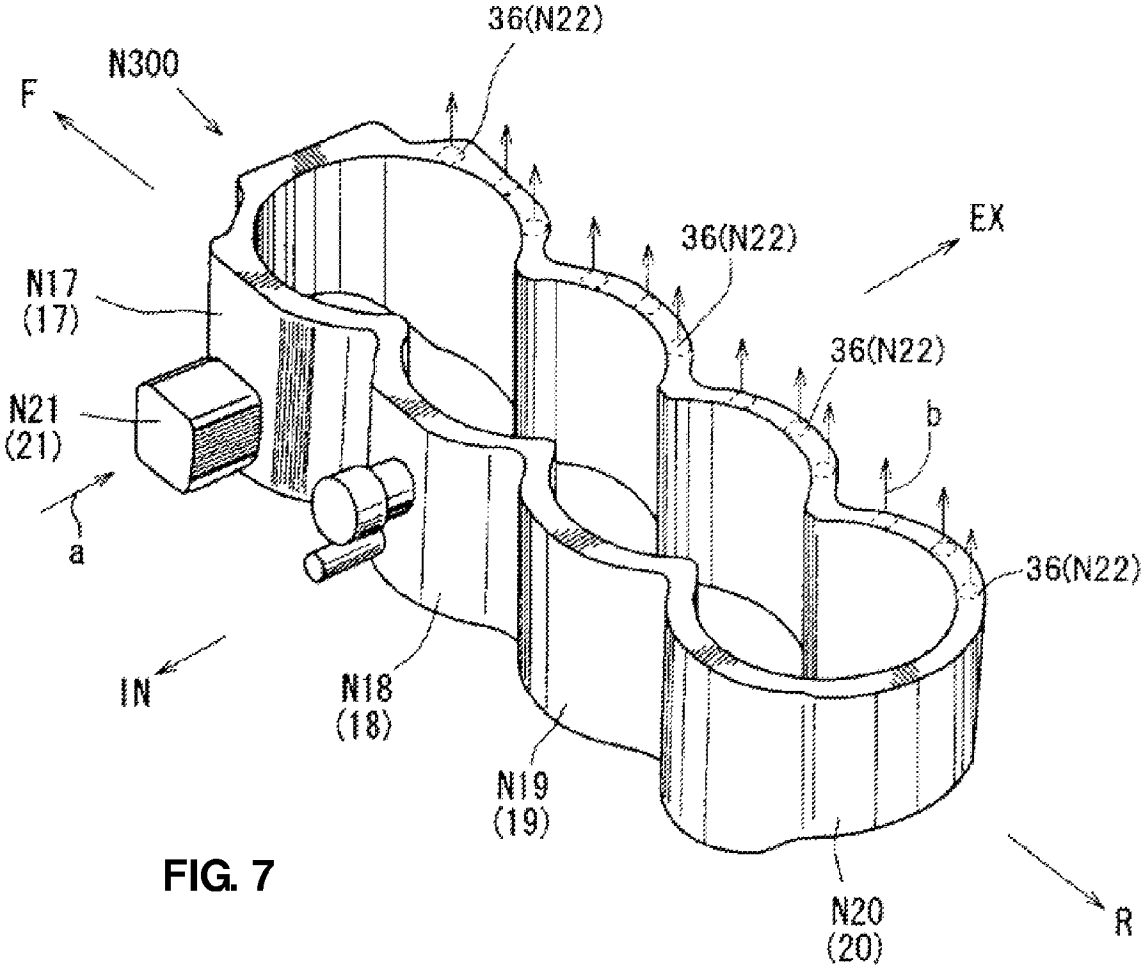
FIG. 7 is a perspective view of the block jacket core.

The cooling-water-introduction-portion forming portions N22 form inside the cylinder head 3 respective cooling-water introduction holes 22 (cooling-water introduction portions, see FIG. 10) to introduce the cooling water from the water jacket formed around the cylinder bores into the lower jacket portion 100. The cooling-water introduction holes 22 correspond to respective openings 36 (see FIG. 15) for raising the cooling-water of a head gasket 30, which will be described later, and three holes 22 are formed at a portion of the lower core N100 which corresponds to the exhaust-side portion of each cylinder. The respective openings 36 correspond to exhaust-side portions of the water jacket which are formed around the cylinder bores (portions formed by forming portions N17, N18, N19 and N20 of the block-jacket cores N300 which will be described later) as shown in FIG. 7.

The upper core N400 to form the upper jacket 400, as shown in FIGS. 5 and 6, an upper-core body N401 (exhaust-side-upper-space forming portion), a cooling-water-discharge-portion-for-air-conditioning forming portion (sub-cooling-water-discharge-portion forming portion) N23, a supercharger-cooling-water-discharge-portion forming portion N24 (sub-cooling-water-discharge-portion forming portion), an supply-portion forming portion N25, and connecting-passage forming portions N26. The upper-core body N401, the cooling-water-discharge-portion-for-air-conditioning forming portion N23, the supercharger-cooling-water-discharge-portion forming portion N24, the supply-portion forming portion N25, and the connecting-passage forming portions N26 are formed integrally.

The upper-core body N401 forms an exhaust-side upper space 27 (see FIG. 9 and others) which is arranged above the exhaust passage including the exhaust ports 7 of the respective cylinders and expands above the exhaust-side lower space 15.

The cooling-water-discharge-portion-for-air-conditioning forming portion N23 and the supercharger-cooling-water-discharge-portion forming portion N24 project from an exhaust-side end portion of the upper-core body N401 toward the exhaust side. The cooling-water-discharge-portion-for-air-conditioning forming portion N23 forms, at an exhaust-side end portion of the upper jacket 400, a cooling-water discharge portion for air conditioning which connects to the exhaust-side upper space 27 to guide the cooling water inside the exhaust-side upper space 27 to a heater core for air conditioning. The supercharger-cooling-water-discharge-portion forming portion N24 forms, at the exhaust-side end portion of the upper jacket 400, a discharge portion which connects to the exhaust-side upper space 27 to guide the cooling water inside the exhaust-side upper space 27 to a supercharger.

The supply-portion forming portion N25 is provided at a portion which is located on a rear side and an intake side of the upper core N400 and corresponds to the above-described connecting passage for EGR 13. This supply-portion forming portion N25 forms a supply portion to supply the cooling water to an EGR valve.

Figure 8:
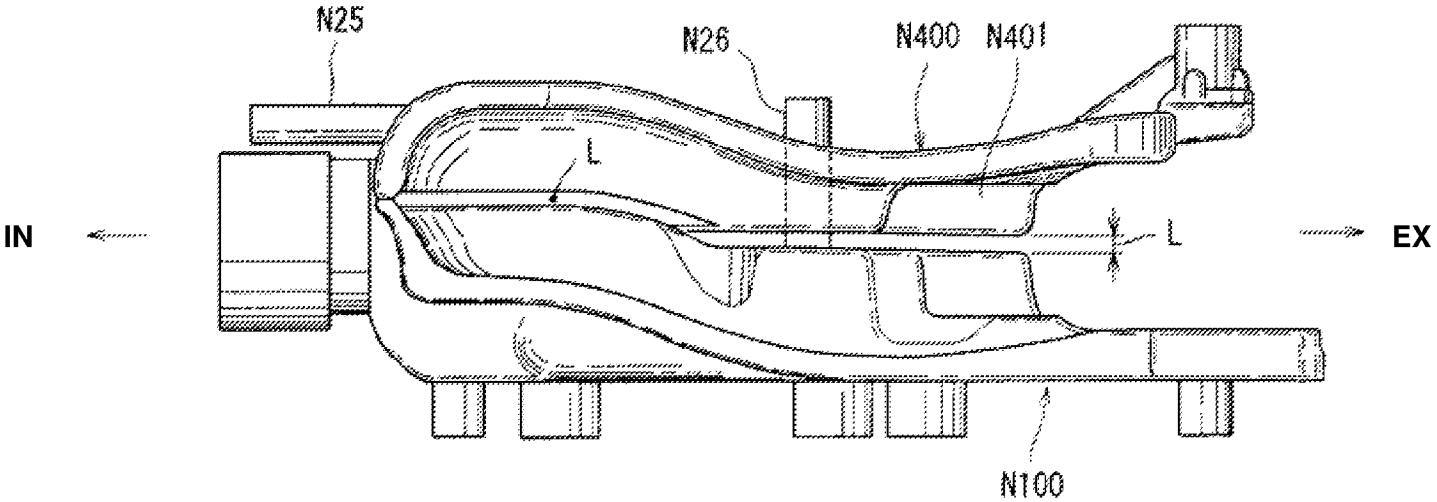
FIG. 8 is a back view showing a state in which the lower core and the upper core are combined together.

As shown in FIG. 8, the lower core N100 is positioned below the upper core N400 in a state of being combined with the upper core N400. In this combination state, the lower core N100 and the upper-core body N401 of the upper core N400 are located away from each other vertically with a distance of L.

The connecting-passage forming portions N26 are provided at respective portions between the cylinders #1-#4. Specifically, the connecting-passage forming portions N26 are formed between the cylinder #1 and the cylinder #2, between the cylinder #2 and the cylinder #3, and between the cylinder #3 and the cylinder #4. The connecting-passage forming portions N26 form respective connecting passages 26 (connecting passages, see FIG. 9) which connect the lower jacket 100 and the upper jacket 400. In a state in which the lower core N100 and the upper core N400 are combined together, the lower core N100 and the upper-core body N401 are away from each other vertically and these cores N100, N400 are continuous vertically at the connecting-passage forming portions N26.

The connecting-passage forming portions N26 are of a vertically-extending columnar shape. Accordingly, the connecting passages 26 formed by the connecting-passage forming portions N26 are formed as a cylindrical hole extending vertically.

The hole's diameter size of the connecting passage 26 of the connecting-passage forming potion N26 is properly set so that the amount of cooling water flowing into the upper jacket 400 from the lower jacket 100 through the connecting passage 26 can cool the cylinder head appropriately, without excessively (too-much) cooling the exhaust gas flowing down through the exhaust passage. Specifically, this hole's diameter size is set at 1/10 of the cylinder bore's diameter or larger and 1/5 of the cylinder bore's diameter or smaller, and this hole's area is sufficiently smaller than a sectional area (a sectional area in a direction perpendicular to a hole's axis) of the upper core N400 and the lower core N100.

In FIG. 4, the connecting-passage forming portions N26 are illustrated by a mark ○ at the lower core N100 for convenience to show that they are positioned between the cylinders.

As shown in FIG. 4, the exhaust-passage core N200 to form the exhaust passage inside the cylinder head 3 comprises forming portions N5, N7, N8, N9, N10, N11, N12 and N13 to form the exhaust-valve openings 5, the exhaust ports 7, the exhaust collective portion 8, the branch passage 9, the opening portion 10, the opening portion 11, the connecting passage 12 and the EGR connecting passage 13, respectively. These forming portions are formed integrally. As shown in FIGS. 5, 6 and 7, the block-jacket core N300 to form a water jacket around the cylinder bores of the cylinder block 2 forms the water jacket inside the cylinder block 2 having an open deck structure. The block-jacket core N300 comprises forming portions N17, N18, N19 and N20, and a cylinder-block-side cooling-water-introduction-portion forming portion N21. The forming portions N17, N18, N19 and N20 form a water jacket around the cylinder bores of the cylinders #1-#4 of the cylinder block 2. The cylinder-block-side cooling-water-introduction-portion forming portion N21 projects toward the intake side from the forming portion N17 of the first cylinder #1.

Herein, the block-jacket core N300 is different from the other cores in forming the forming portions N17-N20 and the cylinder-block-side cooling-water-introduction-portion forming portion N21 by a metal mold.

The processes of casting the cylinder head 3 by using the cores N100, N200 and N400 described above will be described.

Each of the cores N100, N200 and N400 is formed with a gas-hardening type of shell core.

Core Setting Process

First, the lower core N100, an intake-passage core (not illustrated) to form the intake passage, the exhaust-passage core N200 and the upper core N400 are set at the metal mold (i.e., master mold) of the cylinder head 3. Herein, the upper-core body N401 is set above the exhaust-side-lower-space forming portion N15 of the lower core N100 to be located above and away from the lower core N100 with the distance of L, and a lower face of the connecting-passage forming portion N26 of the upper core N400 is made contact respective portions of an upper face of the lower core N100 which correspond to respect positions between the cylinders. Thereby, the upper face of the portions corresponding to the respective positions between the cylinders and the lower face of the connecting-passage forming portion N26 form a contact face. The sectional area of the connecting-passage forming portion N26 is set to be properly small as described above, so an area of the above-described contact face is rather small compared to the area of the upper core N400 and the lower core N300.

(Casting Process)

(2-1) Molten Metal Process

Next, by using the low pressure die casting method, molten metal is pushed upward in a vertical direction by a low-pressure gas so that the molten metal is poured into a cavity formed between the metal mold and the cores N100, N200, N400.

(2-2) Core Removing Process

After the molten metal is solidified, the cores N100, N200, N400 are removed.

Through removal of the cores, the cylinder head 3 equipped with the water jacket, the outlet port of the cooling water, the exhaust passage and the intake ports which are formed respectively to correspond to the cores N100, N200, N400 is casted.

Specifically, as shown in FIGS. 9-14, after the casing, the lower core N100 expands from the intake side to the exhaust side over an almost entire area along the cylinder-line direction inside the cylinder block 2 to form the lower jacket 100 to cool the cylinder head 2 mainly. Specifically, the intake-side-space forming portion N14 of the lower core N100 forms the intake-side space 14 around the intake ports 7, and the exhaust-side-lower-space forming portion N15 forms the exhaust-side lower space 15 which expands below the exhaust passage including the exhaust ports of the cylinders. As apparent from the shape of the core, the intake-side space 14 and the exhaust-side space 15 are connected to each other inside the lower jacket 100.

Further, as shown in FIG. 1, the main-cooling-water-discharge-portion forming portion N16 of the lower core N100 forms the main-cooling-water discharge portion 16 at the intake-side portion of the lower jacket 100.

Figure 10:
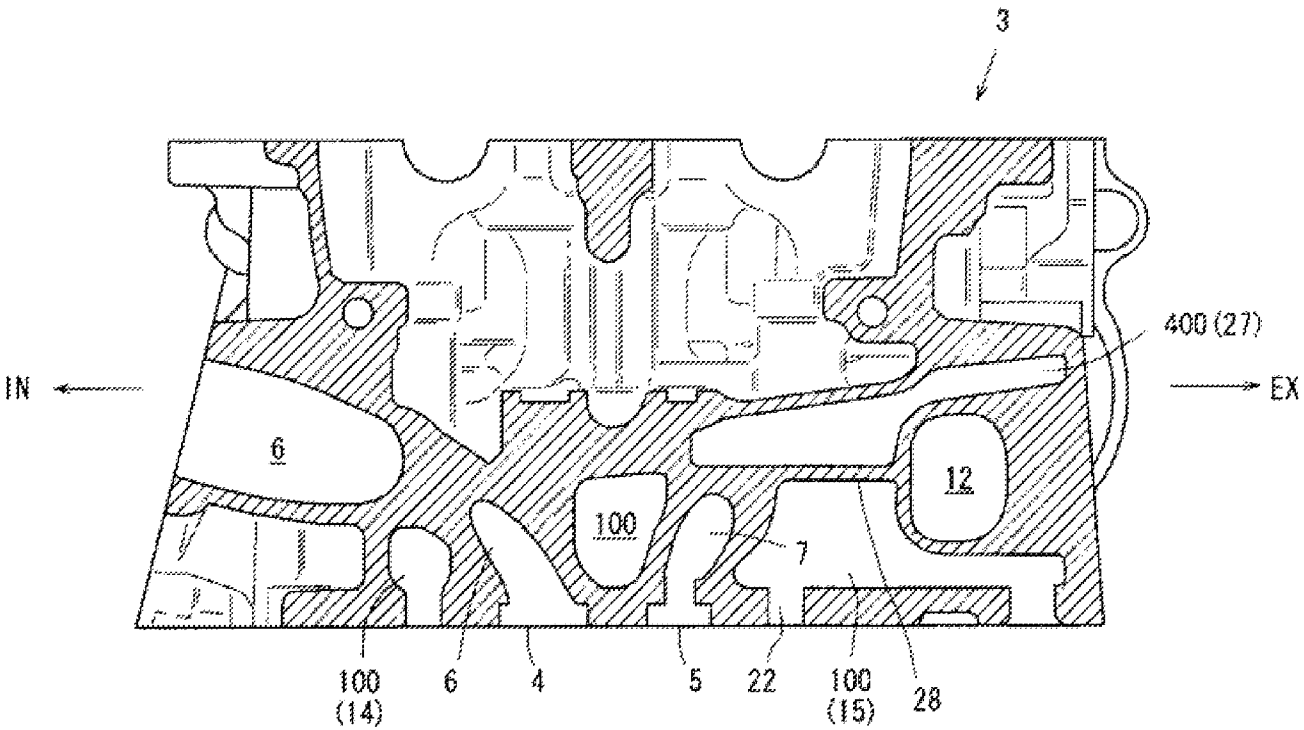
FIG. 10 is a sectional view taken along line A-A of FIG. 2.
Figure 11:
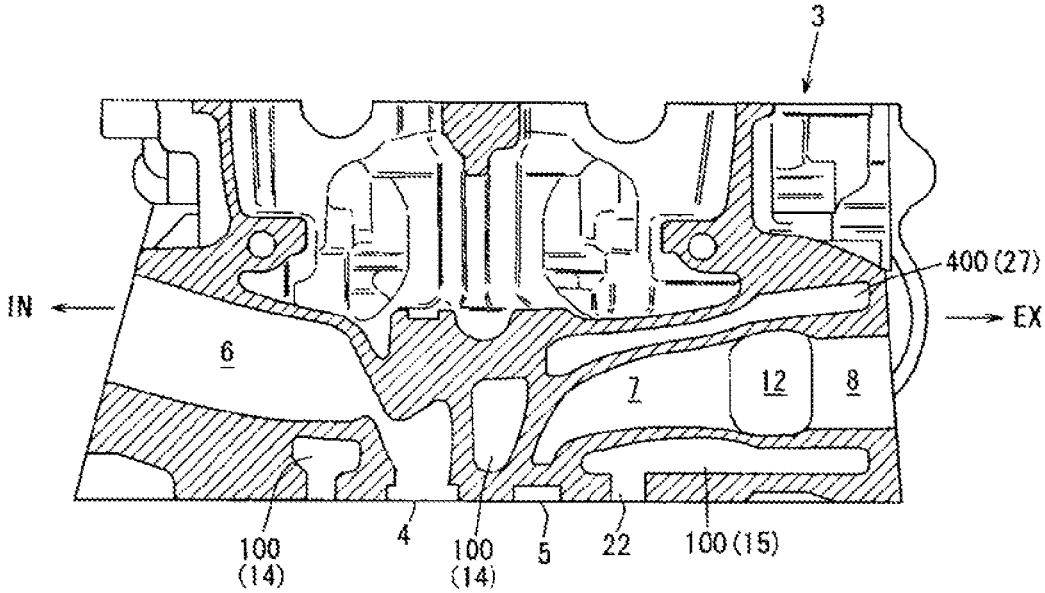
FIG. 11 is a sectional view taken along line B-B of FIG. 2.
Figure 12:
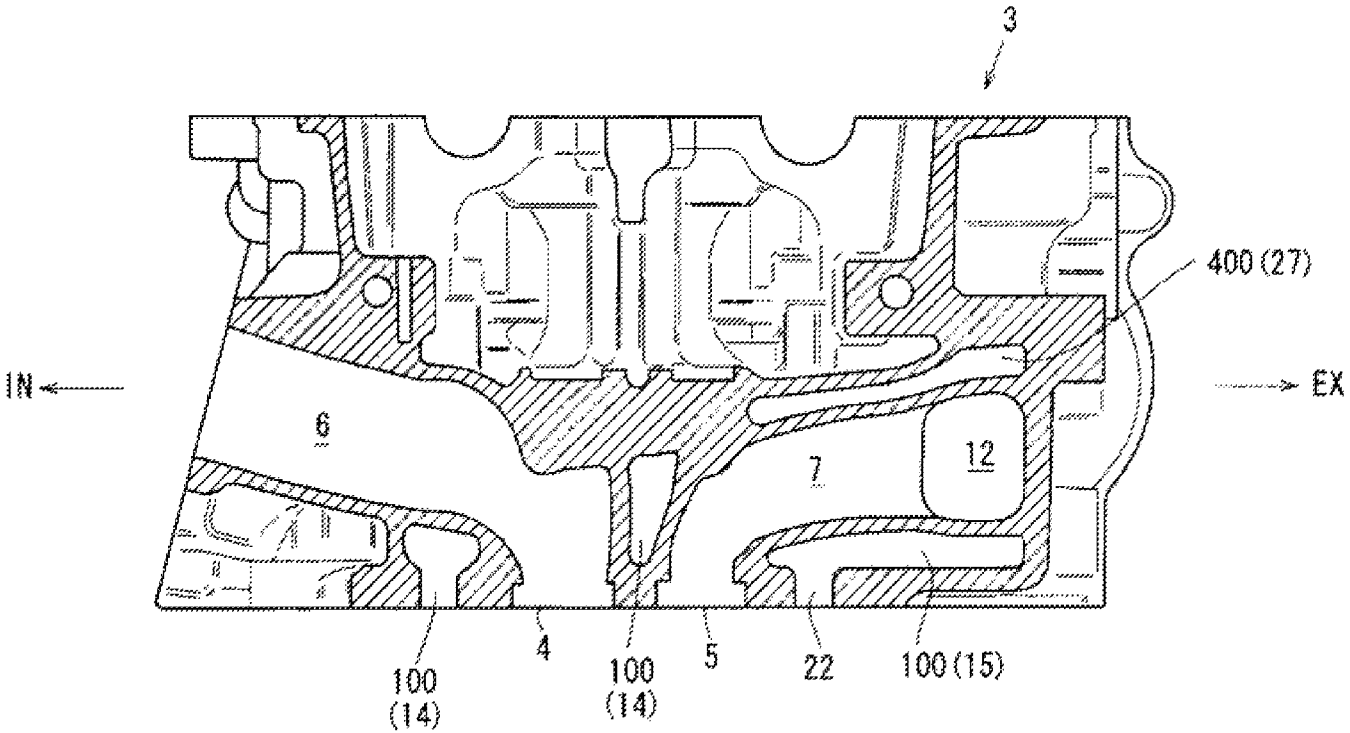
FIG. 12 is a sectional view taken along line C-C of FIG. 2.
Figure 13:
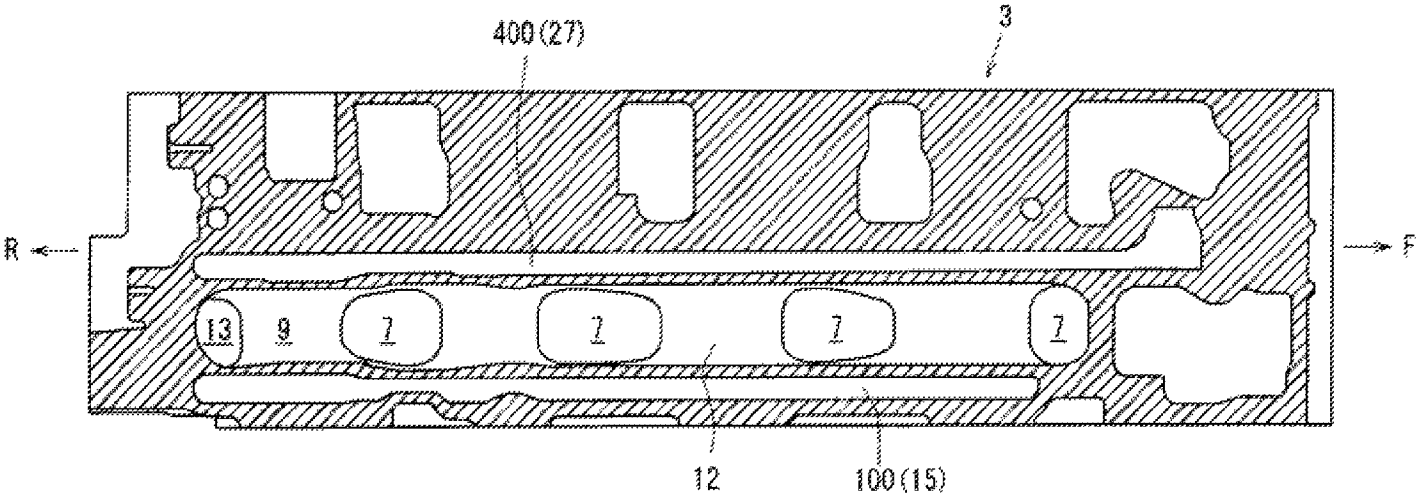
FIG. 13 is a sectional view taken along line D-D of FIG. 2.

Also, as shown in FIG. 10 and others, the cooling-water-introduction-portion forming portions N22 form the cooling-water introduction holes 22 at the exhaust-side portions of the lower jacket 100. The position of an opening at a lower end of this cooling-water introduction hole 22 matches the exhaust-side portion of the water jacket which is formed around the cylinder bore by the block-jacket core N300 in the plan view.

The above-described upper core N400, as shown in FIGS. 9-14, forms the upper jacket 400 to cool the cylinder head 2 additionally.

Specifically, the upper-core body N401 of the upper core N400 forms the exhaust-side upper space 27 which is arranged above the exhaust passage including the exhaust ports 7 of the respective cylinders and expands above the exhaust-side lower space 15. The connecting-passage forming portion N26 of the upper core N400 forms the connecting passages 26 connecting the exhaust-side lower space 15 and the exhaust-side upper space 27. The connecting passages 26 are formed the portions between the cylinders #1-#4 (i.e., between the cylinder #1 and the cylinder #2, between the cylinder #2 and the cylinder #3, and between the cylinder #3 and the cylinder #4) as shown in FIG. 2. Further, the connecting passages 26 are located at different positions from the cooling-water introduction holes 22 in the plan view as shown in FIG. 2. Specifically, the connecting passages 26 are formed on the intake side of the cooling-water introduction holes 22. The cooling-water-discharge-portion-for-air-conditioning forming portion N23 and the supercharger-cooling-water-discharge-portion forming portion N24 which are formed on the exhaust side of the upper core N400 form, respectively, the above-described cooling-water discharge portion for air conditioning 23 to guide the cooling water to the heater core for air conditioning and the above-described cooling-water discharge portion for supercharger 24 to guide the cooling water to the supercharger.

Figure 14:
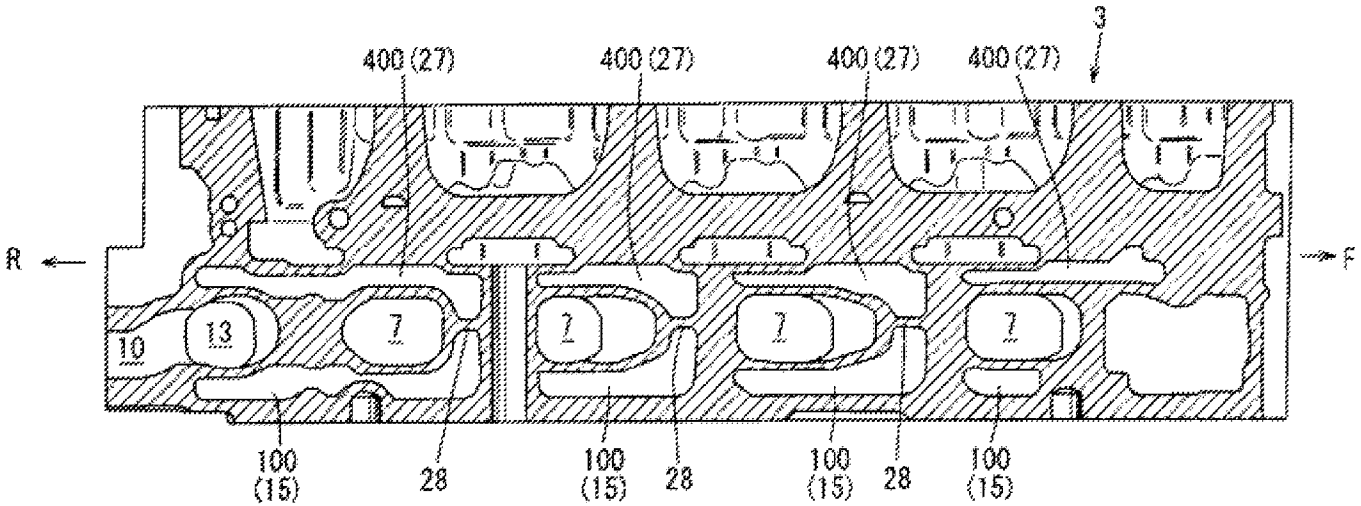
FIG. 14 is a sectional view taken along line E-E of FIG. 2.

The lower core N100 and the upper-core body N401 of the upper core N400 are located away from each other vertically with the distance of L as described above. Accordingly, between the lower jacket 100 and the upper jacket 400 is formed the wall portion 28 which corresponds to a gap of the distance of L as shown in FIGS. 10 and 14, and the both jackets 100, 400 (more specifically, the lower jacket 100 and the exhaust-side upper space 27) are separate from each other vertically via the wall portion 28. In the present embodiment, as shown in FIGS. 10 and 14, the wall portion 28 is located at a central position of the exhaust passage in the vertical direction.

The lower jacket 100 and the upper jacket 400 are connected to each other via the connecting passage 26.

(3) Casting-Fin Removing Step

The upper face of the portions corresponding to the respective positions between the cylinders and the lower face of the connecting-passage forming portion N26 of the lower core N100 form the contact face as described above. Herein, casting fins may form at this contact face, i.e., the opening end of the lower end of the connecting passages 26 formed by the connecting-passage forming portion N26. Thus, the casting fins are removed in this casting-fin removing step.

As described above, the connecting passage 26 is the circular hole (cylindrical hole). Accordingly, in this step a drill is inserted into the connecting passage 26 and then rotated, so that the casting fins forming at the connecting passage 26 is removed off the connecting passage 26. Herein, since the connecting passage 26 is the circular hole, the casting fins can be easily removed with the drill.

Figure 9:
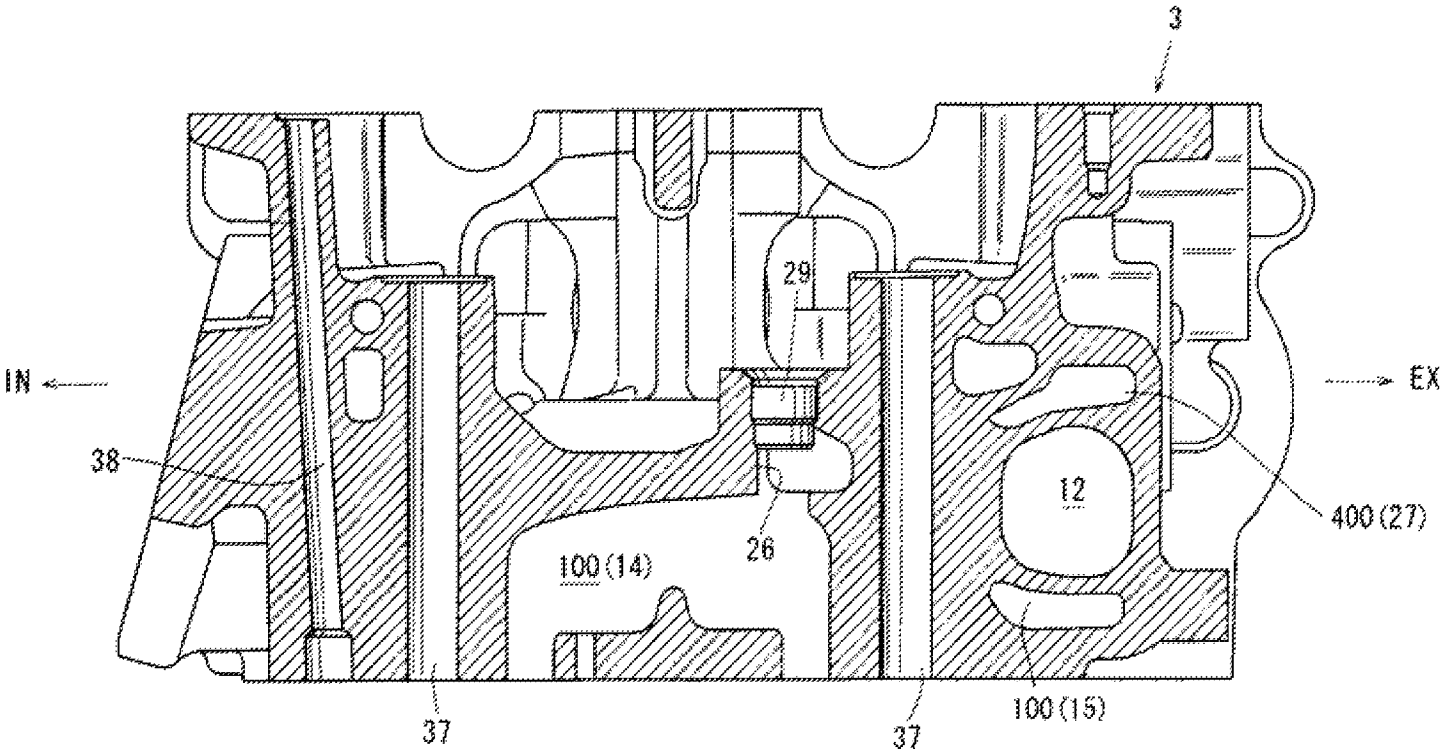
FIG. 9 is a sectional view taken along line X-X of FIG. 2.

Then, after drilling, a plug 29 is inserted into an upper end portion of the connecting passage 26 to close the upper-end opening of the connecting passage 26 with the plug 29 as shown in FIG. 9.

Thus, manufacturing of the cylinder head 3 is finished.

The cylinder block 2 is casted separately from the cylinder head 3. In the casting step of the cylinder block 2, the block-jacket core N300 forms a water jacket of the cylinder block 2 with the open deck structure. Further, the forming portions N17-N20 form water jackets 17-20 around the cylinder bores. Also, the cylinder-block-side cooling-water-introduction-portion forming portion N21 forms a cylinder-block-side cooling-water introduction portion 21 (see FIG. 1).

Figure 15:
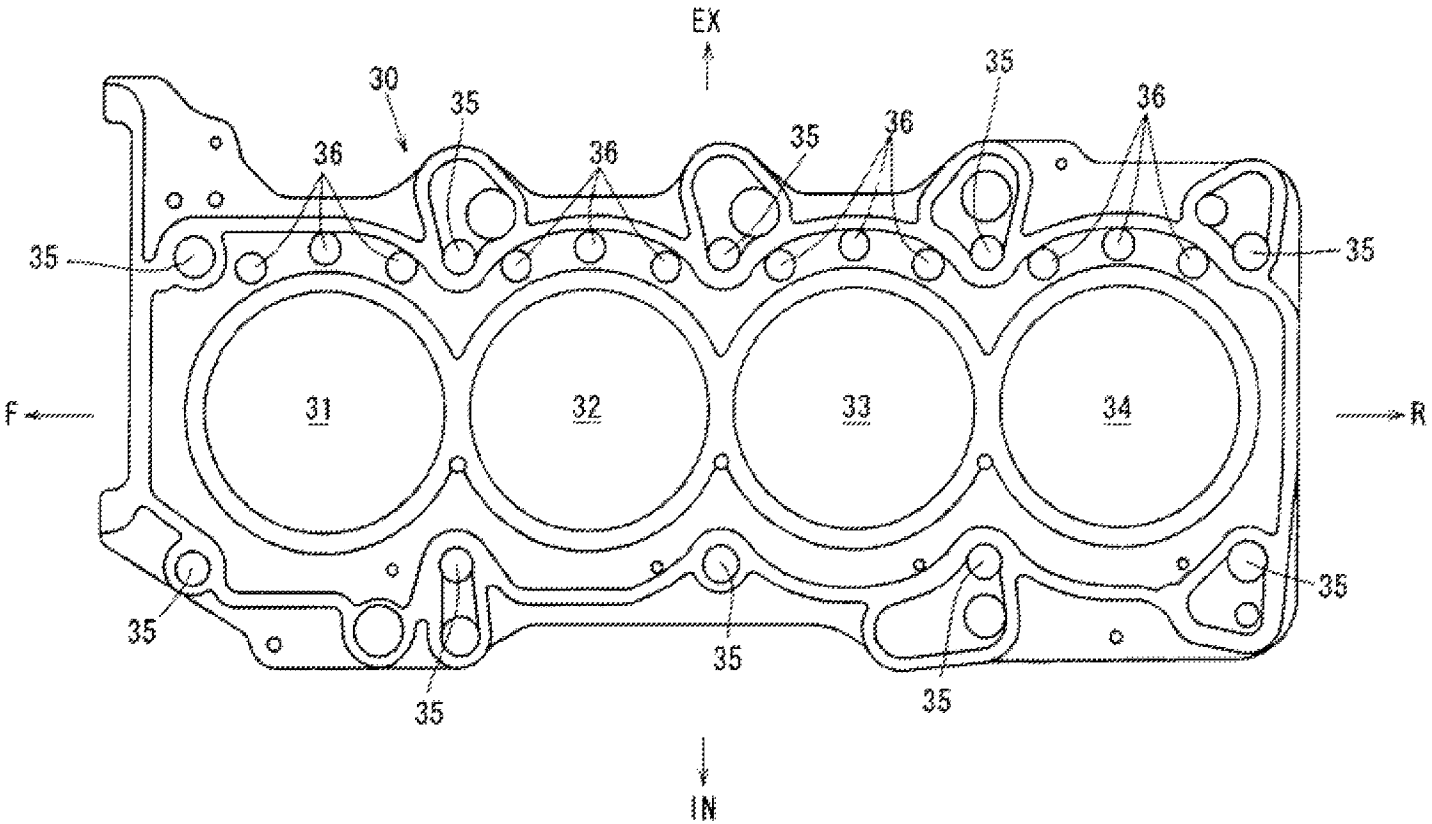
FIG. 15 is a plan view of a head gasket.

FIG. 15 is a plan view of a head gasket 30 provided between the cylinder block 2 and the cylinder head 3. Plural openings 31, 32, 33, 34 which correspond to the cylinder bores, plural bolt through holes 35, and three openings for cooling-water introduction 36 for each cylinder are formed at the head gasket 30. A bolt to fasten the cylinder head 3 to the cylinder block 2 is inserted into each of the bolt through holes 35.

In a state in which the head gasket 30 is provided between the cylinder block 2 and the cylinder head 3, the openings for cooling-water introduction 36 are located at respective exhaust-side upper portions of the water jackets 17-20 formed by the forming portions N17, N18, N19, N20 of the above-described core N300 at the cylinder block 2, and connect to the above-described cooling-water introduction holes 22. The openings for cooling-water introduction 36 allow the cooling water to flow from the cylinder block 2 to the cylinder head 3. That is, the cooling water is introduced into the lower jacket 100 formed at the cylinder head 3 from the water jackets 17-20 of the cylinder block 2 through the openings for cooling-water introduction 36 and the cooling-water introduction holes 22. The opening area of each opening for cooling-water introduction 36 is set properly so that the amount of cooling water flowing toward the cylinder head 3 can be appropriate.

Herein, as shown in FIGS. 2 and 9, bolt through holes 37 of bolts to fasten the cylinder head 3 to the cylinder block 2 are formed at the cylinder head 3. Further, a hole for oil level gage 38 is formed at the cylinder block 3.

Hereafter, the cooling function of the cooling device manufactured as described above will be described.

The cooling water flows into the water jackets 17-20 formed around the cylinder bores of the cylinder block 2 from the cylinder-block-side cooing-water introduction portion 21 as shown by an arrow a in FIG. 7. The cooling water having flowed in flows from the intake-side portions of the water jackets 17-20 toward the exhaust-side portions, then, as shown by an arrow b in FIG. 7, raises from the exhaust-side portions and then flows into the lower jacket 100 of the cylinder head 3, passing through the openings for cooling-water introduction 36 of the head gasket 30 and the cooling-water introduction holes 22.

The cooling-water introduction holes 22 connect to the openings for cooling-water introduction 36 formed at the exhaust-side portions of the water jackets 17-20. Accordingly, the cooling water inside the water jackets 17-20 flows into the exhaust-side portions of the lower jacket 100, i.e., the exhaust-side lower space 15, and then flows toward the intake-side portions of the lower jacket 100. This cooling water cools portions around the exhaust-valve openings 5, 5 and the intake-valve openings 4, 4, the exhaust and intake valves, and the combustion chamber formed at each cylinder, when flowing through the lower jacket 100. The cooling water having cooled the exhaust valves and the others, as shown by an arrow e in FIG. 6, flows out from the above-described main-cooling-water introduction hole 16 to the lower jacket 100 and toward the outside of the cylinder head 3. Meanwhile, a part of the cooling water having flowed into the lower jacket 100 flows into the upper jacket 400, through the above-described connecting passages 26. As described above, the cooling-water introduction portion 22 and the connecting passage 26 are located away from each other in the plan view. Further, the cooling-water discharge portion for air conditioning 23 and the cooling-water discharge portion for supercharger 24 which discharge the cooling water to the outside are formed at the exhaust-side portion of the upper jacket 400. Accordingly, the cooling water having flowed into the lower jacket 100 passing through the cooling-water introduction portion 22 flows into the upper jacket 400 when passing through the lower jacket 100, and the cooling water having flowed into the upper jacket 400 flows toward the exhaust side inside the upper jacket 400, without returning toward the lower jacket 100. In particular, the connecting passages 26 are located on the intake side of the cooling-water introduction portions 22, so that the water inside the lower jacket 100 flows from the exhaust side to the intake side. Thus, the cooling water inside the lower jacket 100 surely flows into the upper jacket 400 through the connecting passages 26 when flowing toward the intake side.

The cooling water having flowed into the upper jacket 400 flows toward the exhaust side and then flows out from the sub-cooling-water discharge portions 23, 24, as shown by arrows c, d in FIG. 6. The cooling water flowing out from the sub-cooling-water discharge portions 23, 24 flows toward the heater core for air conditioning and the supercharger.

Herein, the lower jacket 100 and the upper jacket 400 are connected to each other only via the connecting passages 26, and their main portions are separate vertically from each other via the wall portion 28. Thereby, the amount of cooling water flowing into the upper jacket 400 from the lower jacket 100 and the amount of cooling water flowing from the lower jacket 100, along the exhaust ports 7, toward the upper jacket 400 can be made properly small. Also, the upper jacket 400 can be properly away from the exhaust passage, so that the cylinder head 3 can be properly cooled by the both jackets 100, 400 and the excessive cooling of the exhaust passage (see the respective elements 7, 8, 12 in FIG. 3) can be restrained.

In particular, the cooling-water introduction portions 22 are formed between the cylinders and further away from the exhaust ports 7, compared to a case in which these portions 22 are arranged between the exhaust ports. Accordingly, it can be restrained that the cooling water passing through the cooling-water introduction portions 22 cools excessively (too-much) the exhaust gas inside the exhaust ports 7.

As described above, according to the device of the present embodiment, the exhaust ports 7 and the exhaust collective portion 8 are disposed inside the cylinder head 3, the cylinder head 3 can be cooled properly, and the excessive (too-much) cooling of the exhaust gas inside the exhaust ports 7 and the like can be restrained.

Further, according to the manufacturing method of the present embodiment, since the core N100 to form the lower jacket 100 is different from the core N400 to form the upper jacket 400, and these cores N100, N400 join to each other at the lower face of the connecting-passage forming portions N26, these jackets 100, 400 are connected to each other, the properly-thick wall portion can be provided between the exhaust-side lower space 15 of the lower jacket 100 and the exhaust-side upper space 27 of the upper jacket 400, and the jackets 100, 400 having complex shapes can be formed properly.

Further, since the jackets 100, 400 are formed by using the different cores, the volume of the connecting-passage forming portion N26, i.e., the volume of the connecting passages 26, can be more easily adjusted, ensuring the rigidity of the cores, compared to a case in which these jackets are formed with a single core.

Also, the casting fins forming at the contact face of the cores N100, N400 of the jackets can be removed through an easy process of inserting the drill into the connecting passages 26 and rotating the drill in the casting-fin removing step, so that the removing of the casting fins can be conducted efficiently and precisely.

The present invention should not be limited to the above-described embodiment, and any other modifications and improvements may be applied within the scope of a sprit of the present invention.

For example, while the inline four-cylinder diesel engine is exemplified in the above-described embodiment, the cooling device of an engine according to the present invention is applicable to any other inline multi-cylinder engines.

What is claimed is:

1. A cooling device of a water-cooled engine, in which plural cylinders are arranged in line, and a cylinder head with cross-flow type of intake-and-exhaust arrangement includes at least one intake-valve opening and at least one exhaust-valve opening which are arranged for each cylinder, all of the intake-valve openings for the plural cylinders being disposed on one side of the cylinder head relative to an engine's center along a cylinder line direction, all of the exhaust-valve openings for the plural cylinders are arranged at the other side of the cylinder head, intake ports and exhaust ports which connect to respective combustion chambers of the plural cylinders through the intake-valve openings and the exhaust-valve openings, respectively, and an exhaust collective portion which connects to the exhaust ports for the plural cylinders via a connection portion, the cooling device comprising:

a main cooling jacket portion of a cooling jacket formed in the cylinder head, the main cooling jacket portion including an intake-side space formed around the intake-valve openings and an exhaust-side lower space formed around the exhaust-valve openings, the intake-side space and the exhaust-side lower space being connected to each other;

a sub cooling jacket portion of the cooling jacket formed in the cylinder head, the sub cooling jacket portion including an exhaust-side upper space formed at a level above said exhaust-side lower space; and a connecting passage extending vertically to connect said main cooling jacket portion and said sub cooling jacket portion, the connecting passage connecting a portion located between the cylinders of said main cooling jacket portion and a portion located between the cylinders of said sub cooling jacket portion, the connecting passage being comprised of a cylindrical hole, a diameter size of which is set at 1/10 of a diameter of a cylinder bore formed at a cylinder block of the engine or larger and 1/5 of the diameter of the cylinder bore or smaller, wherein said exhaust-side upper space of the sub cooling jacket portion is configured to expand along the cylinder line direction over substantially a half area, in a plan view, of the cylinder head which is located on the other side of the cylinder head where the exhaust-valve openings for the plural cylinders are arranged so as to cover over the exhaust ports, the connection portion, and the exhaust collective portion of the cylinder head, without covering over the intake ports, and said main cooling jacket portion and said sub cooling jacket portion are separate from each other vertically via a wall portion in another area than said connecting passage.

2. The cooling device of a water-cooled engine of claim 1, wherein said main cooling jacket portion comprises a cooling-water introduction portion which is provided at an exhaust-side portion thereof and introduces cooling water from a cylinder block located below the cylinder head into said exhaust-side lower space of the main cooling jacket portion and a main cooling-water discharge portion which is provided at an intake-side portion thereof to connect to said intake-side space and discharges the cooling water flowing inside the main cooling jacket portion to an outside of the cylinder head, said connecting passage and said cooling-water introduction portion are located away from each other in a plan view, and said sub cooling jacket portion comprises a sub cooling-water discharge portion which is provided at an exhaust-side portion thereof to connect to said exhaust-side upper space and discharges the cooling water flowing inside the sub cooling jacket portion to the outside of the cylinder head.

* * * * *